US005582355A

United States Patent [19]

Nakamura et al.

[11] Patent Number: 5,582,355

[45] Date of Patent: Dec. 10, 1996

[54] BOBBIN THREAD REMOVING DEVICE

[75] Inventors: Masao Nakamura; Sumio Goto; Nozomi Iwasaki, all of Tokyo, Japan

[73] Assignee: Juki Corporation, Tokyo, Japan

[21] Appl. No.: 388,034

[22] Filed: Feb. 14, 1995

[30] Foreign Application Priority Data

Feb. 15, 1994 [JP] Japan ..... 6-040351
Dec. 29, 1994 [JP] Japan ..... 6-338979

[51] Int. Cl.[6] ..... B65H 63/00; B65H 54/00; B65H 51/00; D05B 57/10

[52] U.S. Cl. ..... 242/36; 112/186; 242/47; 242/128; 242/20

[58] Field of Search ..... 242/36, 586, 128, 242/129.1, 562, 125.1, 20, 35.5 T, 35.5 A, 47, 35.6 E, 563; 112/278, 273, 186, 180

[56] References Cited

U.S. PATENT DOCUMENTS

| | | | |
|---|---|---|---|
| 3,633,835 | 1/1972 | Beers | 242/36 |
| 3,845,320 | 10/1974 | Winberg | 242/36 X |
| 4,002,130 | 1/1977 | Rovin et al. | 112/186 X |
| 4,117,789 | 10/1978 | Rovin et al. | 242/20 X |
| 4,195,292 | 3/1980 | Puhich | 242/36 X |
| 4,681,050 | 7/1987 | Kosmas | 112/180 X |
| 5,143,004 | 9/1992 | Mardix et al. | 112/186 |
| 5,350,127 | 9/1994 | Arnold et al. | 242/36 X |

FOREIGN PATENT DOCUMENTS

| | | |
|---|---|---|
| 58-42570 | 3/1983 | Japan . |
| 1-91897 | 4/1989 | Japan . |
| 5-192476 | 8/1993 | Japan . |
| 6-272 | 1/1994 | Japan . |
| 7-80177 | 3/1995 | Japan . |
| WO84/03310 | 8/1984 | WIPO . |

*Primary Examiner*—Michael R. Mansen
*Attorney, Agent, or Firm*—Morgan, Lewis and Bockius LLP

[57] ABSTRACT

A bobbin thread removing device includes a bobbin rotatably supported on the bobbin thread removing device; pull-out apparatus for pulling out a thread wound on the bobbin; bobbin rotation detecting device for detecting the rotation of the bobbin from which the thread is being removed; and control device receiving a signal from the bobbin rotation detecting devices, for driving the pull-out apparatus to pull the thread out again when the control device detects that the bobbin is not turning in accordance with the signal from the bobbin rotation detecting devices.

7 Claims, 6 Drawing Sheets

BOBBIN THREAD REMOVING DEVICE

BACKGROUND OF THE INVENTION

This invention relates to a residual bobbin thread removing/eliminating device (hereinafter referred to as "a bobbin thread removing device", when applicable) used in an automatic bobbin thread feeding apparatus.

In the case where stitch lines of a sewing machine directly appear on a fabric or clothes, a look of a cloth is damaged by a partial stitch line created when a thread from a bobbin is exhausted. Therefore, the commercial value of the cloth goes down, particularly in case of a jacket or coat. If a partial stitch line occurs, additional labor is required to undo the partial stitch line and restitch the fabric from the beginning. To avoid such a waste of time, an operator has to monitor the thread of the bobbin at all times, and has to try to estimate the time when the thread from the bobbin will run out. Therefore, productivity is decreased, and further additional labor is are required.

To supply the thread continuously, a conventional thread feeding device is used. In the conventional thread feeding device, one bobbin in the needle position can be exchanged with another bobbin on which the thread is wound. However, the conventional thread feeding device can not remove the residual thread from the bobbin which is exchanged after the designated stitch operation. In this conventional thread feeding device, the operator must remove the thread from the bobbin by hand. Therefore, productivity is also decreased, and still further labor is required.

SUMMARY OF THE INVENTION

In view of the foregoing, an object of the invention is to provide a bobbin thread removing device that is high in reliability and is able to remove a residual thread from a bobbin.

According to a first aspect of the invention, there is provided a bobbin thread removing device comprising: a bobbin rotatably supported on the bobbin thread removing device; pull-out means for pulling out a thread wound on the bobbin; bobbin rotation detecting means for detecting the rotation of the bobbin from which the thread is being removed; and control means receiving a signal from the bobbin rotation detecting means, for driving the pull-out means to pull the thread out again when the control means detects that the bobbin is not turning in accordance with the signal from the bobbin rotation detecting means.

According to a second aspect of the invention, there is provided a bobbin thread removing device comprising: a bobbin rotatably supported; winding means including a holding member selectively holding and releasing the end portion of a thread wound on the bobbin, the winding means being turned around an axis for winding the thread held by the holding member thereon; bobbin rotation detecting means for detecting the rotation of the bobbin from which the thread is being removed; and control means receiving a signal from the bobbin hold to wind the thread again when the control means detects that the bobbin is not turning.

According to a third aspect of the invention, there is provided a bobbin thread removing device comprising:

winding means including a thread removing member, and a plurality of linear members secured to the thread removing member, the linear members being arranged around the thread removing member and being protruded outwardly;

a receiving shaft for receiving the winding means which is being moved forwardly, to turn together with the winding means such that the winding means is moved forwardly so that the end portion of a thread wound on a bobbin is held between the thread removing member and the receiving shaft; the winding means turning for a predetermined period of time so that the thread wound on the bobbin is wound on the linear members, and that thereafter the winding means is stopped and moved backwardly;

bobbin rotation detecting means for detecting the rotation of the bobbin from which the thread is being removed; and control means receiving a signal from the bobbin rotation detecting means, and operating the winding means to hold and wind the thread again when the control means detects that the bobbin is not turning.

The bobbin thread removing device of the first aspect of the invention operates as follows: When it is detected by the bobbin rotation detecting means that the bobbin is not turning during the thread removing operation, then the control means determines that the pull-out means has failed in pulling the thread out, and causes the pull-out means to perform the thread pull-out operation again.

The bobbin thread removing device of the second aspect of the invention operates as follows: The end portion of the thread wound on the bobbin is held by the holding member of the winding means, and is then wound on the holding member as the winding means is turned. When it is detected by the bobbin rotation detecting means that the bobbin is not turned during the thread removing operation, the control means determines that the winding means has failed in holding the end portion of the thread, and causes the winding means to perform the thread holding and winding operation again.

The bobbin thread removing devices of the third aspect of the invention operate as follows: As the winding means is moved forwardly, the end portion of the thread wound on the bobbin is held between the thread removing element and the receiving shaft, and it is wound on the linear members as the winding means is turned for the predetermined period of time, and thereafter the winding means is stopped and moved backwardly. When it is detected by the bobbin rotation detecting means that the bobbin is not turned during the thread removing operation, the control means determines that the winding means has failed in holding the end portion of the thread, and causes the winding means to perform the thread holding and winding operation again.

DETAILED DESCRIPTION OF THE PREFERRED EMBODIMENTS

A preferred embodiment of the invention will be described with reference to the accompanying drawings.

Figure 6:
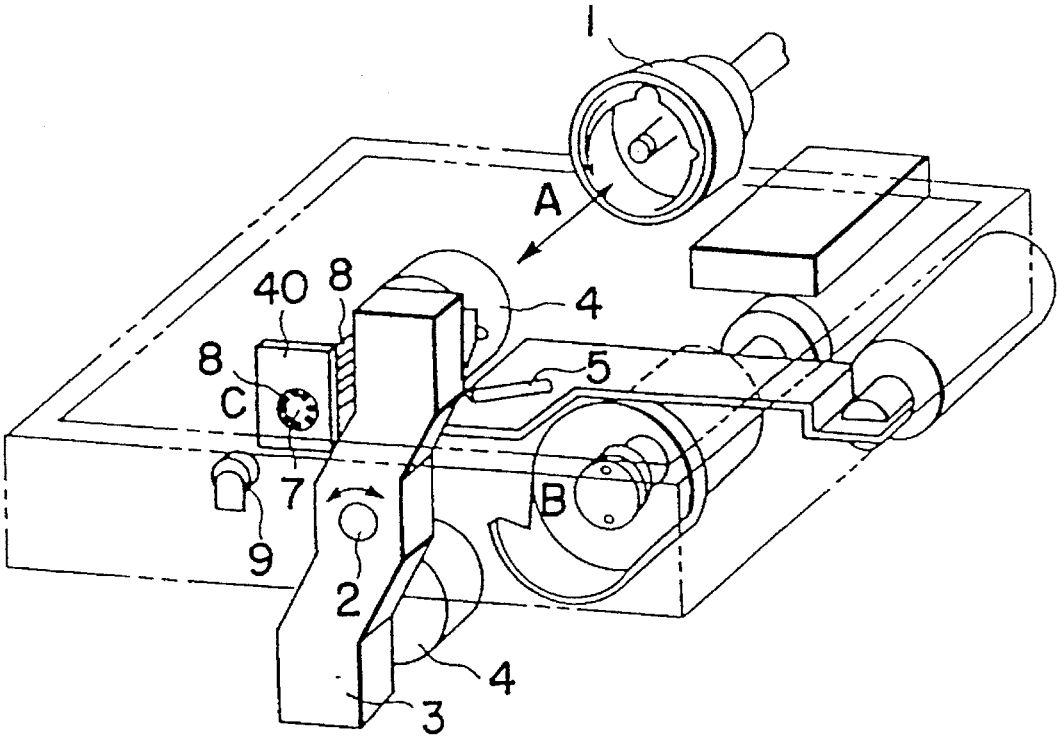
FIG. 6 PRIOR ART
FIG. 6 is a perspective view outlining an automatic lower thread feeding device to which the bobbin thread removing device shown in FIG. 1 is applied.

First, an automatic lower thread feeding device, to which a bobbin thread removing device of the invention is applied, will be described with reference to FIGS. 6 and 7.

Figure 7:
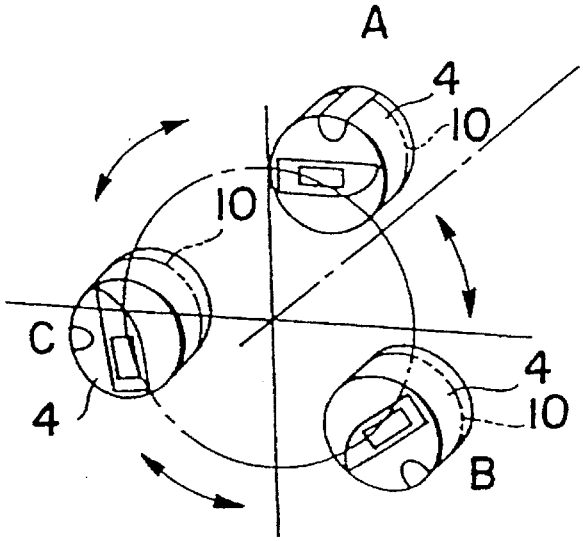
FIG. 7 PRIOR ART
FIG. 7 is a perspective view showing the postures of a bobbin casing positioned in work zones in the automatic lower thread feeding device.

The automatic lower thread feeding device is located in the space around a rotating hook 1 below a sewing machine bed, and has a bobbin casing engaging and disengaging zone (corresponding to a sewing position) A, a lower thread winding zone B, and a remaining thread removing zone C which are each arranged around a transfer shaft 2 at angular intervals of 120° as shown in FIG. 7. A transfer member 3, which is fixedly mounted on the transfer shaft 2 and has two bobbin casings 4 incorporating bobbins 10, is turned through the bobbin casing engaging and disengaging zone A, the lower thread winding zone B and the remaining thread removing zone C.

In the lower thread feeding device, the transfer member 3 is turned forwardly or reversely by a pulse motor (not shown). In the bobbin casing engaging and disengaging zone A, at a bobbin casing replacing position, the bobbin casing 4 is engaged with or disengaged from the rotating hook 1; that is, the bobbin casing 4 is moved from the rotating hook 1 to the transfer member 3 or from the transfer member 3 to the rotating hook 1. In the lower thread winding zone B, a lower thread winding device (for example, as disclosed by Unexamined Japanese Patent Publication No. Hei. 6-272) winds a lower thread on the bobbin 10 in the bobbin casing 4 from which the remaining thread has been removed. In the remaining thread removing zone C, the thread remaining in the bobbin casing 4 on the transfer member 3, which has been disengaged from the rotating hook 1 in the bobbin casing engaging and disengaging zone A, is removed by the bobbin thread removing device according to the invention.

Figure 8:
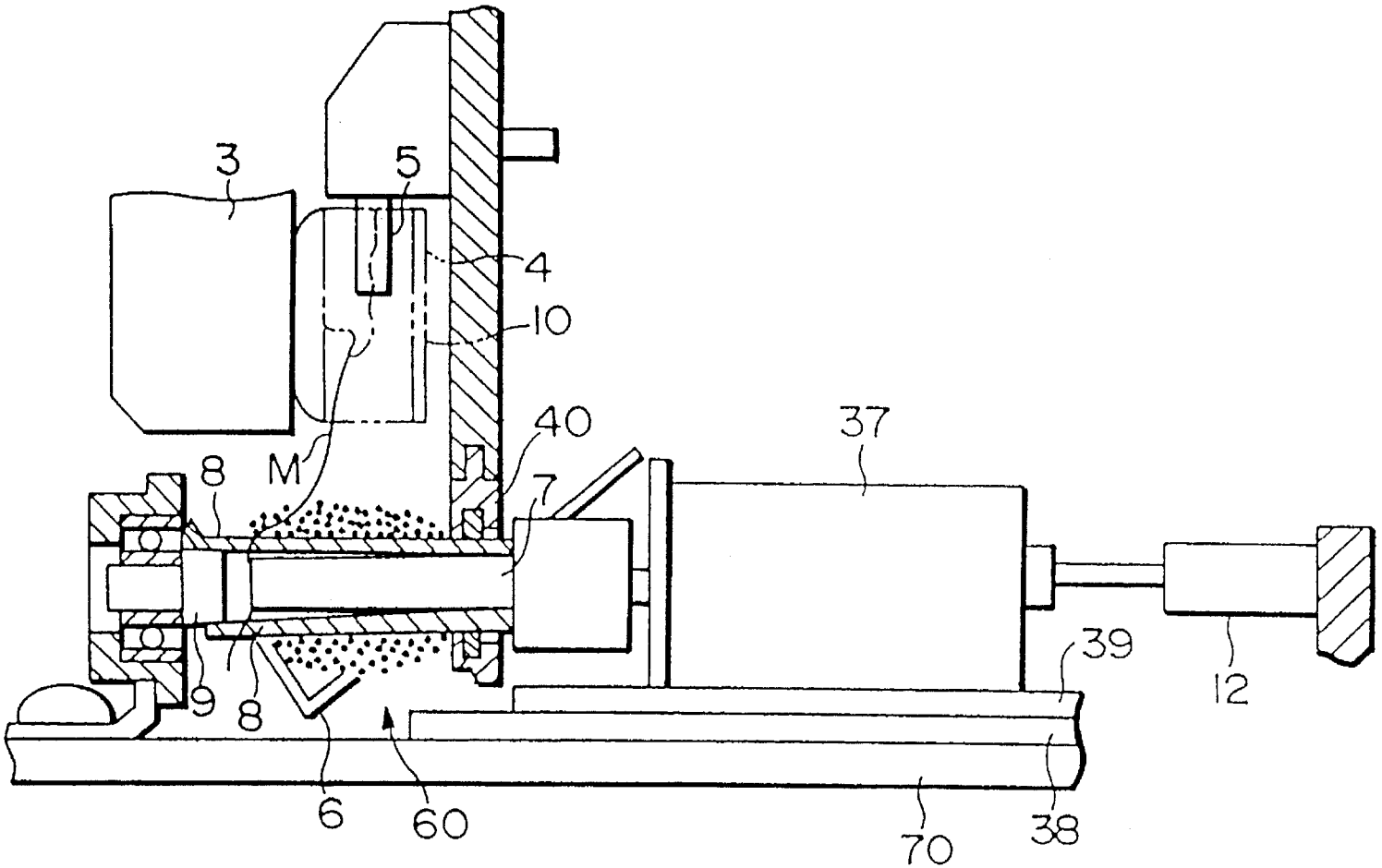
FIG. 8 is a partly front view of the bobbin thread removing device of the invention.

The bobbin thread removing device of the invention is as shown in FIGS. 1 through 3 and 8. The bobbin thread removing device, as shown in FIG. 8, comprises: an air nozzle 5 for blowing a thread M dropped down from a bobbin 10 through a bobbin casing 4 so that it is brought to the work position; a guide 6 for holding the thread M thus brought; a slide guide 38 fixedly mounted on a base 70; a slide board 39 which is horizontally slidable along the slide guide 38 as viewed in FIG. 8; an electric motor 37 fixedly mounted on the slide board 39; winding-means moving means, namely, an air cylinder 12 for sliding the motor 37 and the slide board 39 longitudinally along the slide guide 38 (right and left in FIG. 8); a thread removing member which, in this case, is a thread removing shaft 7 that is moved back and forth by the air cylinder and turned by the motor 37; a plurality of fingers which, in this case, include a plurality of elastic fingers 8 having their rear ends fixedly secured to the rear end of the thread removing shaft 7 and their front end portions extended ahead of the front end of the thread removing shaft 7, the thread removing shaft 7 and the elastic fingers 8 forming the aforementioned winding means 60; a blocking board 40 receiving the winding means 60; and a receiving shaft 9 which receives the thread removing shaft 7 and the elastic fingers 8 which are moved forwardly, and turns together with them. Further in FIG. 8, reference numeral 3 designates a transfer member which holds the bobbin casing 4 and turns it to a predetermined position.

The bobbin thread removing device thus constructed operates as follows:

The air nozzle blows the thread M of the bobbin 10 which is dropped down from the bobbin casing 10 so that it is laid over the guide 6. Under this condition, the air cylinder 12 is operated to move the thread removing shaft 7 and the elastic fingers 8 forwardly. As a result, the elastic fingers 8 are spaced from one another in such a manner as to surround the receiving shaft 9, so that the thread M is set between the thread removing shaft 7 and the receiving shaft 9. Under this condition, the motor 37 is operated to turn the thread removing shaft and the elastic fingers 8, so that the thread M is wound on the latter. Thereafter, the thread removing shaft 7 and the elastic fingers 8 are moved backwardly. Hence, the elastic fingers 8, being disengaged from the receiving shaft 9, are caused to approach one another to slacken the thread M wound thereon. The thread M thus slackened is detained by the blocking board 40, finally being dropped down from the elastic fingers 8.

The bobbin thread removing device has a bobbin rotation detecting means, for example, a reflection type photo-interrupter 11 which is so positioned as to confront with the flange-side surface (the right end face in FIG. 1) **10*b* of the bobbin 10 which is exposed from the bobbin casing 4 when the bobbin casing 4 is set in the remaining thread removing zone C by the transfer member 3**.

Figure 2:
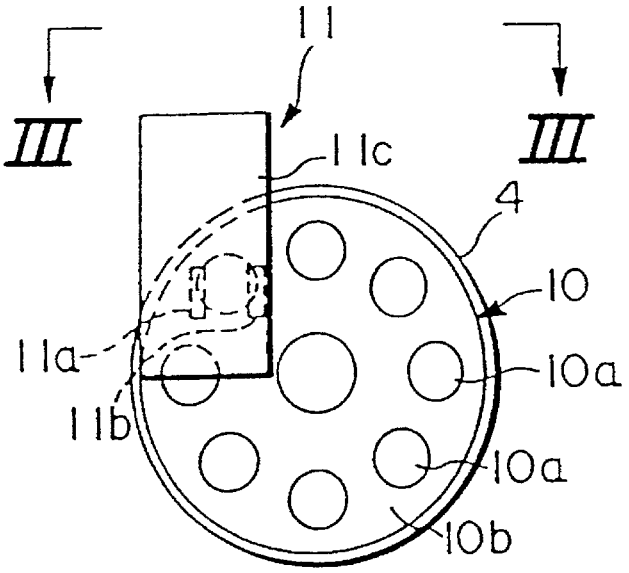
FIG. 2 is a view taken in the direction of the arrow I—I in FIG. 1.
Figure 3:
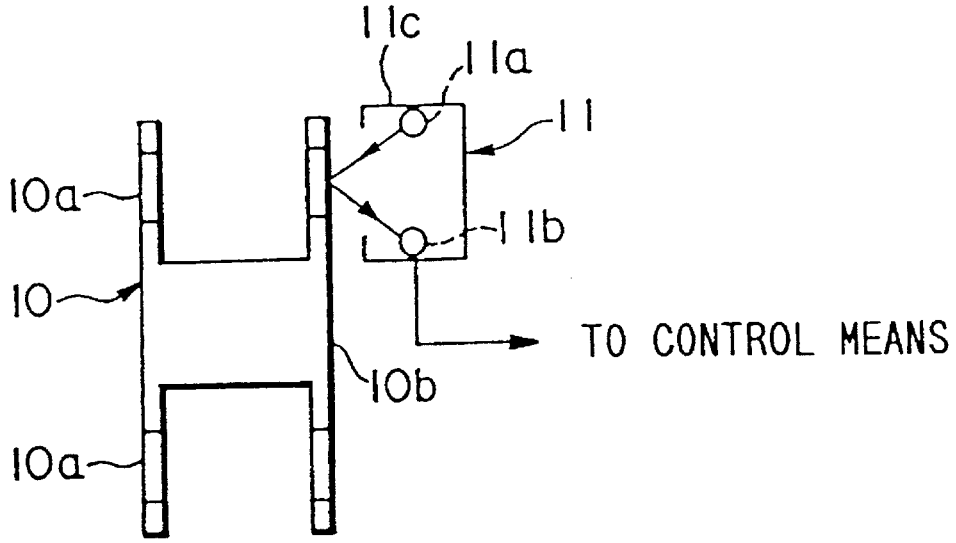
FIG. 3 is a view taken in the direction of the arrow III—III in FIG. 2.

The reflection type photo-interrupter 11, as shown in FIGS. 2 and 3, comprises: a light emitting element **11*a* for emitting a light beam; a light receiving element 11*b* for receiving the light beam which is emitted from the light emitting element 11*a* and reflected by the flange-side surface 10*b* of the bobbin 10; and a casing 11*c* incorporating the light emitting element 11*a* and the light receiving element 11*b***.

The other arrangement of the bobbin thread removing device, except for control means described later, is substantially equal to that of the conventional device described with reference to FIG. 8.

Figure 1:
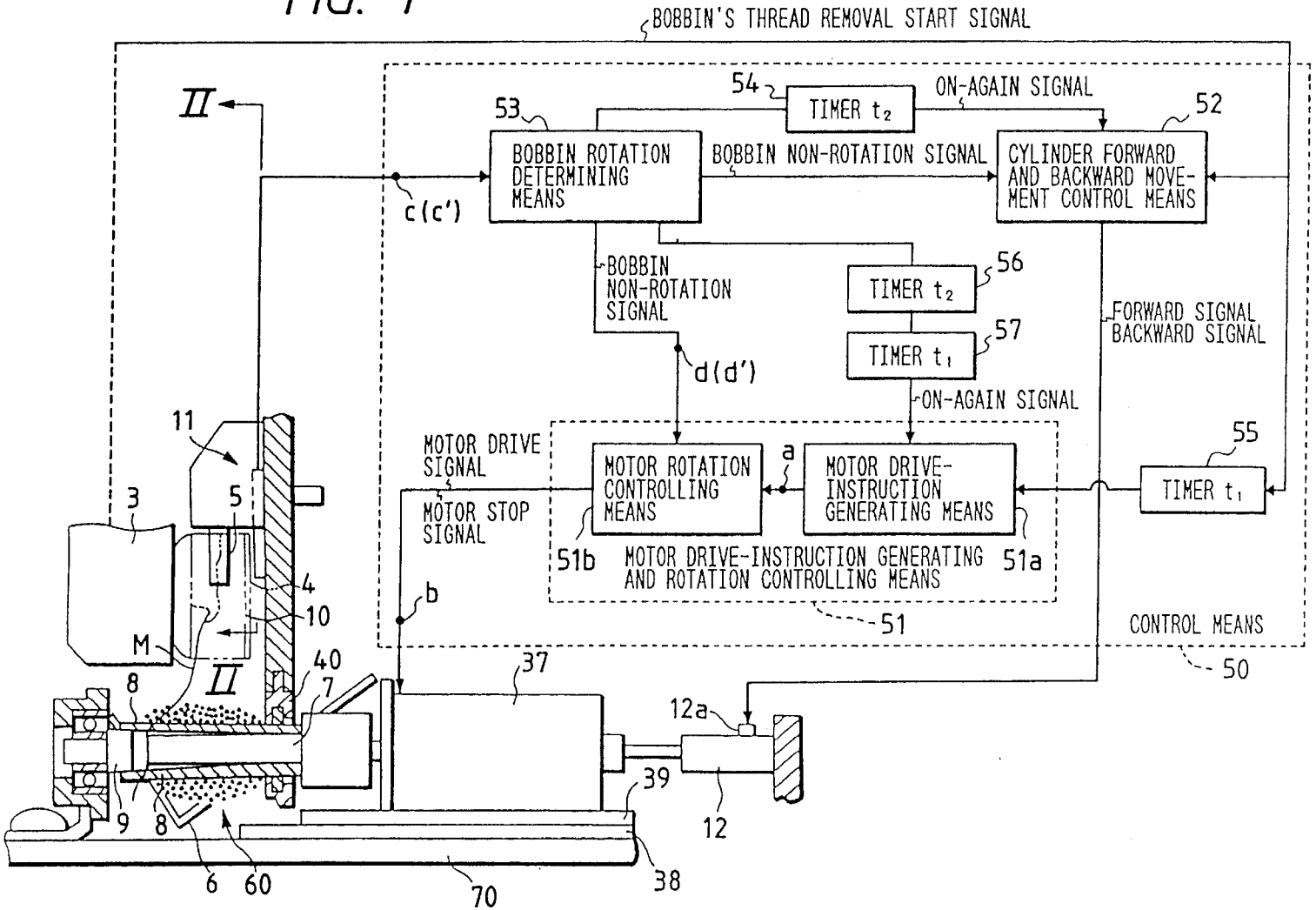
FIG. 1 is an explanatory diagram, partly as a block diagram, showing the whole arrangement of a bobbin thread removing device of the invention.

The above-described automatic lower thread feeding device, as shown in FIG. 1, has control means 50 which operates as follows: In response to a signal from the bobbin rotation detecting means (not shown), which detects from the angle of rotation of the pulse motor, that the bobbin casing 4 has been set in the remaining thread removing zone C by the transfer member 3, control mean 50 provides a remaining-thread removal start signal. In response to the output signal of the light receiving element **1*b* in the reflection type photo-interrupter 11, the control means 50 applies motor drive and stop signals to the motor 37, and forward and backward signals to an electromagnetic valve 12*a* adapted to control the forward and backward movements of the air cylinder 12**.

The control means 50 is a so-called "microcomputer" which controls an ordinary (or conventional) thread removing operation, and, when it is determined from the output signal of the light receiving element **11*b* in the reflection type photo-interrupter 11 that the bobbin 10 is not turning, operates in the same way as the means for causing the winding means 60** to perform the thread catching and winding operation again.

More specifically, the control means 50, as shown in FIG. 1, comprises: bobbin rotation determining means 53; winding-means, forward and backward movement control means, namely, cylinder forward and backward movement control means 52; and motor drive-instruction generating and rotation controlling means 51.

The bobbin rotation determining means 53 operates as follows. The means 53 receives the output signal of the light receiving element 11*b*. When it is determined from the output signal that the bobbin 10 is not turned, the means 53 outputs a bobbin non-rotation signal, and outputs an "on-again" signal which is delayed by a predetermined time t2 from the bobbin non-rotation signal with the aid of timers 54 and 56.

The cylinder forward and backward movement control means 52 operates as follows: Upon reception of the remaining thread removal start signal, the means 52 applies a forward signal (an "on" signal) to the electromagnetic valve 12*a* to move the cylinder head of the air cylinder 12 forwardly so that the thread wound on the bobbin 10 is caught between the thread removing member 7 and the receiving shaft 9. A predetermined time after the application of the "on" signal, the means 52 applies a backward signal (an "off" signal) to the electromagnetic valve 12*a* to retract the cylinder head. In the case where the means 52 receives the bobbin non-rotation signal, the means 52 applies the reverse signal (the "off" signal) to retract the cylinder head, and upon reception of the "on-again" signal which is delayed by the predetermined time t2, outputs the forward signal (the "on-again" signal) again, and applies the backward signal (the "off" signal) to the electromagnetic valve 12*a* a predetermined time after the application of the forward signal, to retract the cylinder head.

The motor drive-instruction generating and rotation controlling means 51 operates as follows: Upon reception of the remaining thread removal start signal, the means 51 applies a drive signal to the motor 37 to rotate it for a predetermined time T (cf. FIG. 5) so that the thread wound on the bobbin 10 is wound on the linear members 8, and, in the predetermined time T, outputs a stop signal to stop the motor. On the other hand, upon reception of the bobbin non-rotation signal, the means 51 applies the stop signal to the motor 37 to stop the latter 37. And upon reception of the "on-again" signal delayed by the predetermined time t2, the means 51 outputs the drive signal again, and, in the predetermined time T, applies the stop signal to the motor 37.

In the motor drive-instruction generating and rotation controlling means 51, its driving and re-driving are delayed as much as a predetermined time t1 by the timers 55 and 57. The means 51 comprises: motor drive-instruction generating means 51*a* for producing a pulse wave signal as a motor drive instruction signal; and motor rotation controlling means 51*b* for setting the period to the predetermined value T for which the motor is driven with the pulse wave signal, and for controlling the speed of the motor 37 to a predetermined value.

Figure 4:
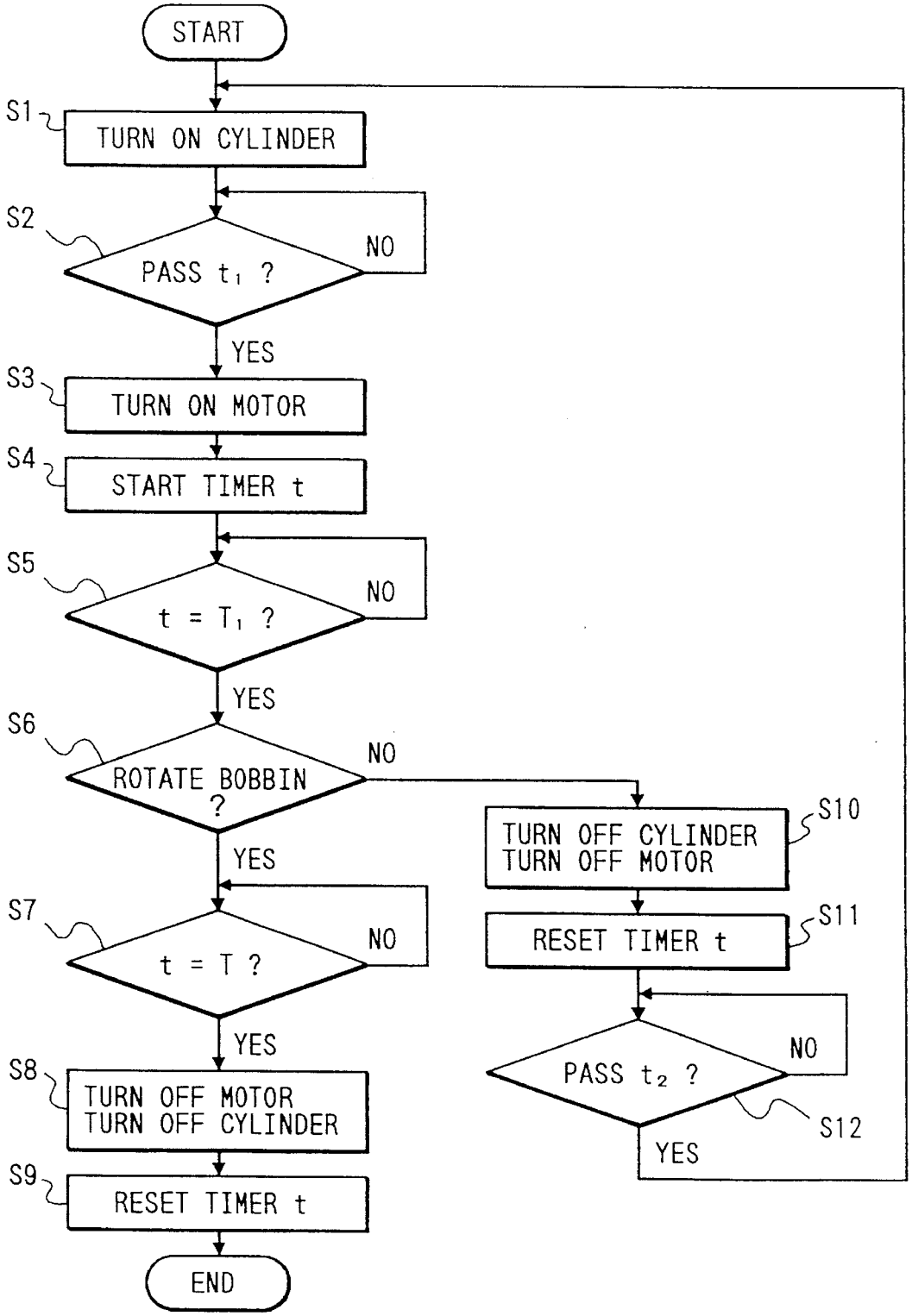
FIG. 4 is a flow chart showing an example of a program stored in a ROM in control means shown in FIG. 1.

The above-described means 50 incorporates a ROM (not shown) in which a program is stored, and a RAM (not shown) in which various set values and data tables are stored and processed. FIG. 4 is a flow chart showing the program stored in the ROM.

The operation of the bobbin thread removing device of the invention will be described with reference to the program.

When the bobbin casing 4 is set in the remaining thread removing zone C by the transfer member 3, the remaining thread removal start signal is produced to start the execution of the program. In Step 1, the "on" signal is applied to the electromagnetic valve 12*a*, to move the cylinder head of the air cylinder 12 forwardly. Next, in Step 2, it is determined whether or not the time t1 has passed.

When the time t1 has not passed yet, then it is determined that the thread removing member 7 is still being moved forwardly, and the end portion of the thread wound on the bobbin 10 is not held between the thread removing member 7 and the receiving shaft 9 yet. Hence, Step 2 is repeatedly effected until the time t1 has passed. When time t1 has passed, it is determined that the end portion of the thread wound on the bobbin 10 is held between the thread removing member 7 and the receiving shaft 9, and Step 3 is effected. In Step 3, the drive signal is applied to the motor 37 to drive the latter 37 for the time T as shown in a wave form (b) of FIG. 5, to turn the winding means 60 in the direction opposite to the direction in which it is turned to wind the thread on the bobbin, so that the thread wound on the bobbin 10 is wound on the linear members 8.

The time T is so determined that it is long enough to wind the thread on the linear members 8 which has been wound on the bobbin 10. The motor drive instruction generating means 51*a* applies a pulse signal (as shown in a wave form (a) of FIG. 5) to the motor rotation controlling means 51*b*.

In Step 4, the timers t are started, and Step 5 is effected. In Step 5, it is determined whether or not the time T has passed since the application of the drive signal. The time T is provided to eliminate the difficulty that, although the winding means 60 has started rotation, the bobbin 10 is not turned yet. Step 5 is repeatedly effected until it is determined that the time T has passed. When it is determined that the time T has passed, Step 6 is effected to determine whether or not the bobbin 10 is turning.

Figure 5:
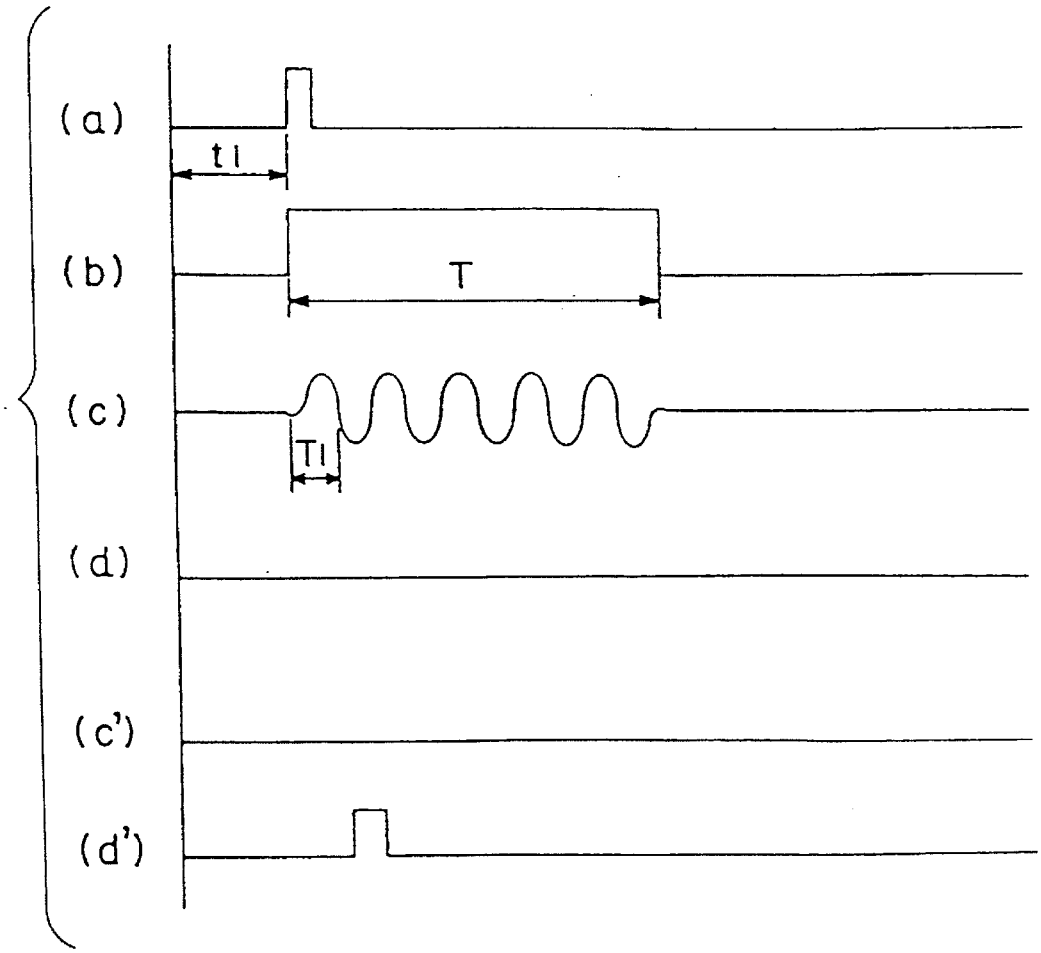
FIG. 5 is a timing chart for a description of the operation of an electric motor in the device of the invention.

As the remaining thread is being removed from the bobbin 10 by the winding means 60 holding its end portion, the bobbin 10 is kept turning, and the light receiving element 11*b* outputs a sine wave signal as shown in a wave form (b) of FIG. 5 because of the following fact: As shown in FIG. 2, a plurality of holes 10*a* are formed in the flange-side surface 10*b* of the bobbin 10, which is exposed from the bobbin casing 4, in such a manner that they are arranged on a circumference at equal angular intervals. Hence, as the bobbin 10 turns, the reflection of the output light beam of the light emitting element 11 changes periodically, and accordingly the quantity of light received by the light receiving element 11*b* also changes periodically. Thus, the light receiving element 11*b* outputs the sinusoidal signal as shown in a wave form (c) of FIG. 5.

In the case where the sine wave signal as shown in the wave form (c) of FIG. 5 or a rectangular wave signal shaped is received, it is determined that the remaining thread is normally removed by the winding means 60, and Step 7 is effected. In Step 7, it is determined whether or not the time T has passed. If the time T has not passed yet, then it is determined that the remaining thread has not thoroughly removed yet, and Step 7 is repeatedly effected until the time T has passed. When the time T has passed, it is determined that the remaining thread has been completely removed, and Step 8 is effected. In Step 8, the stop signal is applied to the motor 37 to stop the latter 37, and the "off" signal is applied to the electromagnetic valve 12*a* to retract the cylinder head of the air cylinder 12 to the original position.

As a result, the linear members 8 are disengaged from the receiving shaft and moved towards each other, to slacken the thread M wound on them. The thread M, being detained by the blocking board 40, is dropped from the linear members 8.

Thereafter, Step 9 is effected to reset the timers t, and the device waits for the next remaining thread removal start signal.

When the remaining thread is being removed by the winding means 60, the bobbin rotation determining means 53 produces no output signal as shown in a wave form (d) of FIG. 5.

In the case where, in Step 6, the sine wave signal or the shaped rectangular wave signal is not provided, and an "off" signal as shown in a wave form (c') of FIG. 5 is received, it is determined that the winding means 60 has failed in removing the remaining thread, and Step 10 is effected. In Step 10, a stop signal as shown in a wave form (d') of FIG. 5 is applied to the motor 37 to stop the rotation of the winding means 60, and the "off" signal is applied to the electromagnetic valve 12*a* to return the cylinder head of the air cylinder 12 to the original position. Next, Step 11 is effected.

In Step 11, the timers t are reset, and Step 12 is effected. In Step 12, it is determined whether or not the time t2 has passed. The time t2 is long enough to completely stop the rotation of the winding means 60 and to completely return the cylinder head of the air cylinder 12 to the original position.

When, in Step 12, it is determined that the time t2 has not passed yet, Step 12 is repeatedly effected until the time t2 passes. When it is determined that the time t2 has passed, Step 1 is effected again. Hence, the above-described operations are carried out all over again; that is, the winding means 60 is caused to perform the thread catching and winding operation again.

The signals designated by reference characters a, b, c, d, c' and d' in FIG. 5 are corresponding to the circuit points designated by the same reference characters in FIG. 1, respectively.

The device of the invention operates as follows: The winding means 60 is moved forwardly, so that the end portion of the thread wound on the bobbin 10 is held between the thread removing member 7 and the receiving shaft 9. Under this condition, the winding means 60 is turned for the predetermined time T, so that the thread wound on the bobbin 10 is wound on the linear members 8. Thereafter, the winding means 60 is stopped and moved backwardly. When the reflection type photo-interrupter 11 detects that, while the remaining thread is being removed, the bobbin is not turned, then the control means 50 determines that the winding means has failed in catching the end portion of the thread wound on the bobbin, and causes the winding means 60 to perform the thread catching and winding operation again. That is, even if the winding means 60 fails in catching the end portion of the thread once, it is operated again to catch the thread, so that the thread remaining on the bobbin 10 is positively removed. Thus, the operation of the device is high in reliability.

While the invention has been concretely described with reference to its preferred embodiment, it should be noted that the invention is not limited thereto or thereby, and it will be obvious to those skilled in the art that various changes and modifications may be made therein without departing from the invention. For instance, in the embodiment, whether or not the bobbin 10 is turned is detected by utilizing the holes 10*a* formed in the bobbin 10; that is, the detection is carried out on the fact that the quantity of light received by the light receiving element 11*b* is varied by the presence of the holes 10*a*. However, the quantity of light received by the light receiving element 11*b* may be varied by other methods. That is, a material different in reflection factor from the surface of the bobbin 10 may be bonded on the latter 10, or the surface of the bobbin 10 may be subjected to surface treatment. Hence, the technical concept of the invention may be applied to a bobbin which does not have such holes.

In the above-described embodiment, the reflection type photo-interrupter 11 which is optically operated is employed as the bobbin rotation detecting means; however, it may be replaced with other means such as magnetic detectors or induction type detectors including magnets, Hall element for detecting the magnetic fields of magnets, magnetic resistance elements, coils, and so forth.

Furthermore, when, in the above-described embodiment, the control means 50 determines that the winding means has failed in catching the end portion of the thread, the motor 37 is stopped and the cylinder head of the air cylinder 12 is returned to the original position, so that the winding means 60 performs the thread catching and winding operation again. However, the same effect may be obtained by modifying the device so that the motor 37 is not stopped, and only the cylinder head of the air cylinder 12 is returned to its original position, to cause the winding means 60 to perform the thread catching and winding operation again.

In the above-described embodiment, the air cylinder 12 is employed as the winding-means moving means for moving the winding means forwardly or backwardly. However, it may be replaced with an actuator. Alternatively, a rack and a pinion may be employed to convert the rotation of the motor into straight motion so that the winding means 60 is moved forwardly or backwardly. In addition, it may be replaced with an electromagnetic solenoid.

According to the above-described flow chart, when the control means 50 determines that the winding means has failed in catching the end portion of the thread wound on the bobbin, the winding means 60 performs the thread catching and winding operation repeatedly until the thread is caught. However, the device may be so designed that, when the winding means 60 has failed in catching the end portion of the thread a certain number of times, an alarm is given so that the device can be stopped by the operator.

In the above-described embodiment, the bobbin thread removing device is applied to the automatic lower thread feeding device; however, it goes without saying that the bobbin thread removing device can be used independently. In this case, the start switch of the bobbin thread removing device is used to output the remaining thread removal start signal.

While the preferred embodiment has been described, the invention is not limited thereto or thereby. For instance, the device may be modified without departing from the invention as follows: The receiving shaft 9 is made movable so that it is moved towards the winding means 60, if necessary. Alternatively, the motor 37 is fixed, and a cylinder is mounted, as the thread removing member, on the output shaft of the motor 37, and the linear members 8 are secured to the cylinder so that the cylinder and the linear members 8 form the winding means. The winding means is moved forwardly or backwardly by the above-described winding-means moving means. In other words, the invention is applicable to a bobbin thread removing device which comprises: winding means including a thread removing member, and a plurality of linear members which are secured to the thread removing member in such a manner that they are arranged around the thread removing member and protruded outwardly; and a receiving shaft for receiving the winding means which is being moved forwardly, to turn together with the latter, in which the winding means is moved forwardly so that the end portion of the thread wound on a bobbin is held between the thread removing member and the receiving shaft, and the winding means is turned for a predetermined period of time so that the thread wound on the bobbin is wound on the linear members, and thereafter the winding means is stopped and moved backwardly. The device may be so modified that the winding means is fixed, so that it is turned and stopped there. Alternatively, instead of the linear members, suitable means may be employed which are opened and closed by a solenoid or the like to hold the thread of the bobbin.

The bobbin thread removing device may be provided pull-out means instead of the winding means. The pull-out means includes a pair of rollers which catch the thread therebetween. When the rollers rotate, the thread is pulled out and removed from the bobbin. Alternatively, instead of the pair of rollers, an air absorbing member may be employed. The air absorbing member absorbs the thread with the air, so that the thread is pulled out and removed from the bobbin.

With the bobbin thread removing device of the invention, the end portion of the thread wound on the bobbin is held by the holding member of the winding means, and is then wound on the holding member as the winding means is turned; however, when the bobbin rotation detecting means detects that the bobbin is not turning while the thread is being removed, then the control means determines that the winding means has failed in holding the end portion of the thread, and causes the winding means to perform the thread holding and winding operation again. That is, when the winding means fails in holding the end portion of the thread, it is caused to perform the thread holding operation again. Hence, the remaining thread is positively removed from the bobbin. Accordingly, the device is high in reliability.

With the bobbin thread removing devices of the invention, the winding means is moved forwardly, so that the end portion of the thread wound on the bobbin is held between the thread removing element and the receiving shaft, and the winding means is turned for the predetermined period of time to wind the thread on the linear members, and thereafter the winding means is stopped and moved backwardly. When, on the other hand, it is detected by the bobbin rotation detecting means that the bobbin is not turned during the thread removing operation, the control means determines that the winding means has failed in holding the end portion of the thread, and causes the winding means to perform the thread holding and winding operation again. Thus, in this case, too, when the winding means fails in holding the end portion of the thread, it is caused to perform the thread holding operation again. Hence, the remaining thread is positively removed from the bobbin. This means that the operation of the device is high in reliability.

What is claimed is:

1. A bobbin thread removing device comprising:

a bobbin having a thread wound thereon;

pull-out means for pulling the thread from the bobbin upon receipt of a drive signal;

bobbin rotation detecting means for detecting a non-rotation of the bobbin; and control means coupled to the pull-out means for producing the drive signal to cause the pull-out means to pull the thread from the bobbin when the bobbin rotation detecting means detects the non-rotation of the bobbin.

2. The bobbin thread removing device according to claim 1, wherein the bobbin rotation detecting means includes a reflection type photo-interrupter positioned proximate to a reflecting surface of the bobbin.

3. The bobbin thread removing device according to claim 2, wherein the reflection type photo-interrupter includes a light emitting element and a light receiving element.

4. A bobbin thread removing device comprising:

a bobbin having a thread wound thereon;

a holding member for selectively holding and releasing an end portion of the thread upon receipt of a drive signal;

winding means for winding the thread held by the holding member onto the holding member upon receipt of the drive signal;

bobbin rotation detecting means for detecting a non-rotation of the bobbin; and control means coupled to the holding member and the winding means for producing the drive signal to cause the holding member and the winding means to hold and wind the thread when the bobbin rotation detecting means detects the non-rotation of the bobbin.

5. The bobbin thread removing device according to claim 4, wherein the bobbin rotation detecting means includes a reflection type photo-interrupter positioned proximate to a reflecting surface of the bobbin.

6. The bobbin thread removing device according to claim 5, wherein the reflection type photo-interrupter includes a light emitting element and a light receiving element.

7. A bobbin thread removing device comprising:

winding means for removing a thread wound on a bobbin, the winding means including a thread removing member and a plurality of linear members secured to the thread removing member, the linear members being arranged around the thread removing member and being protruded outwardly;

a receiving shaft for receiving the plurality of linear members of the winding means as the winding means moves toward the receiving shaft to turn together with the winding means so that a first end portion of the thread is held between the thread removing member and the receiving shaft, wherein the winding means turns for a predetermined period of time so that the thread wound on the bobbin is wound on the linear members, and wherein the winding means thereafter stops turning and moves away from the receiving shaft;

bobbin rotation detecting means for detecting the rotation of the bobbin from which the thread is being removed; and control means receiving a signal from the bobbin rotation detecting means, for driving the winding means to hold and wind the thread again when the control means detects that the bobbin is not turning in accordance with the signal from the bobbin rotation detecting means.

* * * * *